US006495038B1

(12) United States Patent
Kondoh et al.

(10) Patent No.: US 6,495,038 B1
(45) Date of Patent: Dec. 17, 2002

(54) CENTRIFUGAL SEPARATOR WITH VERTICALLY DETACHABLE CASING

(75) Inventors: Yusuke Kondoh, Otsu (JP); Yoshiyuki Shimizu, Otsu (JP); Hiroshi Okabe, Himeji (JP); Kenji Ohya, Takasago (JP)

(73) Assignee: Toyo Kasei Kogyo Co., Ltd., Osaka (JP)

( * ) Notice: Subject to any disclaimer, the term of this patent is extended or adjusted under 35 U.S.C. 154(b) by 0 days.

(21) Appl. No.: 10/018,071

(22) PCT Filed: Jun. 2, 1999

(86) PCT No.: PCT/JP99/02940

§ 371 (c)(1),
(2), (4) Date: Nov. 30, 2001

(87) PCT Pub. No.: WO00/74857

PCT Pub. Date: Dec. 14, 2000

(51) Int. Cl.[7] ..... B04B 7/02; B04B 7/04; B04B 15/06

(52) U.S. Cl. ..... 210/232; 210/360.1; 210/369; 210/380.1; 210/392

(58) Field of Search ..... 210/232, 249, 210/360.1, 369, 373, 380.1, 391, 393, 396, 407, 408, 392

(56) References Cited

U.S. PATENT DOCUMENTS 3,556,303 A * 1/1971 Diebold et al. ..... 210/377
4,557,831 A * 12/1985 Lindsay et al. ..... 210/232
5,306,423 A * 4/1994 Gunter ..... 210/232
6,033,563 A * 3/2000 Hans ..... 210/232
6,165,365 A * 12/2000 Salyer et al. ..... 210/650

FOREIGN PATENT DOCUMENTS

JP 2903396 6/1999

* cited by examiner

*Primary Examiner*—Fred Prince
(74) *Attorney, Agent, or Firm*—Knobbe, Martens, Olson & Bear, LLP

(57) ABSTRACT

The present invention provides a centrifugal separator comprising a top lid, a rotatable basket, a drive unit for the rotatable basket and an outer case, the rotatable basket and the drive unit being mounted on the top lid, the rotatable basket and the outer case having a cake outlet at the bottoms thereof, wherein the top lid is fixedly mounted on a stand via supporting legs, the outer case being supported by and attached to the top lid, the outer case being detachable from the top lid for cleaning and movable downward when detached, whereby the rotatable basket can be exposed to the outside, the centrifugal separator having excellent operability, cleanability, visual observability and antipollution property.

5 Claims, 9 Drawing Sheets

CENTRIFUGAL SEPARATOR WITH VERTICALLY DETACHABLE CASING

TECHNICAL FIELD

The present invention relates to a centrifugal separator, more specifically a centrifugal separator of cake bottom discharge type comprising a rotatable basket and a drive unit thereof on a top lid, wherein a cake is discharged from the bottom of an outer case.

BACKGROUND ART

In the production of medicines, chemicals, foods, etc., measures for preventing introduction of foreign substances into the products must be strictly carried out. Particularly, medicines and their raw materials, which need to be produced according to GNP (Good Manufacturing Practice), should be treated even more strictly to prevent introduction of foreign substances.

When producing medicines and the like, centrifugal separators are often used for separating a material slurry into solid and liquid components. When a material slurry is changed to another kind of material slurry, the centrifugal separator has to be thoroughly cleaned so that the residual raw materials are removed therefrom.

Thus, the centrifugal separators for such applications require consideration for its inner surface to be cleaned. In particular, it is desired for the centrifugal separators that cleaning operation is easy (operability); cleaning can be conducted entirely and thoroughly (cleanability); cleaned parts can be visually observed without difficulty after cleaning (visual observability); and the surroundings of the separator are prevented from contamination with a spent cleaning water (antipollution property), etc.

Heretofore, in the production of medicines and the like, the separation of slurries into solid and liquid components is often conducted using centrifugal separators which have a rotatable basket and a drive unit therefor attached to a top lid and discharge cakes from the bottom of an outer case, i.e., so-called bottom discharge type centrifugal separators. The following are typical examples of this type of centrifugal separators: (a) a centrifugal separator comprising an outer case fixedly mounted on a stand via supporting legs; a top lid equipped with a rotatable basket and a drive unit therefor and mounted on said outer case in a upwardly movable manner; a top lid lifting device which lifts said top lid together with said rotatable basket, when cleaning is operated, to bring said rotatable basket outside said outer case, thereby allowing cleaning the inside of said outer case and said rotatable basket separately (b) a centrifugal separator with the similar structure as that of the above (a) further comprising a cleaning hole in the side wall of the outer case, and a lid of the cleaning hole which is removed when cleaning is carried out so that the inside of the outer case and the rotatable basket can be cleaned through the cleaning hole with the top lid kept on the outer case.

The former centrifugal separator (a) has good cleanability and visual observability because the rotatable basket can be cleaned outside the outer case. However, when cleaning the rotatable basket, a cleaning liquid spreads outside the outer case, resulting in contamination of the surroundings of the apparatus. Thus, the former centrifugal separator has a poor antipollution property. In addition, the top lid, which is equipped with the rotatable basket, the drive unit therefor and many other auxiliary devices, is considerably heavy and troublesome to be lifted up. Moreover, a part of auxiliary devices such as a slurry feeding port, electric wires provided on the top lid have to be temporarily removed therefrom. The removing and resetting of the auxiliary devices are troublesome and pose a problem in operability of the centrifugal separator.

The latter centrifugal separator (b) is free from the problems of the former typo centrifugal separator since the latter does not require lifting the top lid or does not cause spread-out of the cleaning liquid. However, it is impossible to see the inside of the entire outer case and the rotatable basket through the cleaning hole, and therefore insufficiently cleaned parts may remain. Besides, it is difficult to visually check the result of cleaning, offering problems in cleanability and visual observability.

Thus, the conventional centrifugal separators (a) and (b) have both advantages and disadvantages and improvement thereon is being required.

DISCLOSURE OF INVENTION

It is a principal object of the present invention to provide a centrifugal separator of cake bottom discharge type and has excellent operability, cleanability, visual observability and antipollution property.

It is another object of the present invention to provide a centrifugal separator of the above type, wherein a rotatable basket is detachably attached to a drive shaft, and therefore can be cleaned separately from the drive shafts, and the rotatable basket is easily attachable onto the drive shaft after cleaning.

It is another object of the present invention to provide a centrifugal separator of the above type, wherein screws of the drive shaft are replaceable when damaged, so that the drive shaft need not be wholly replaced.

Other features of the present invention will be apparent from the following description.

The present Invention provides a centrifugal separator, wherein a rotatable basket and a drive unit therefor are mounted on a top lid; a cake outlet is provided at the bottom of the rotatable basket and an outer case; the top lid is fixedly mounted on a stand via supporting legs; the outer case is supported by and mounted on the top lid; when cleaning is carried out the outer case can be detached from the top lid; the outer case is downwardly movable when detached form the top lid; the rotatable basket can be exposed to the outside by this downward movement.

In the present invention, the rotational basket is removably attached to its drive shaft. A fastening device is provided at the lower end of the drive shaft in order to fasten the rotatable basket on the drive shaft. The fastening device comprises a bolt member which is connectable coaxially in the axial direction to the lower end of the drive shaft by the operation from the radial direction and a nut member screwed onto the bolt member. The nut member may be selectively screwed at either a first position, a lower part of the bolt member, or a second position, an upper part of the bolt member. When the nut member is at the first position, the bolt member can be coaxially connected to the drive shaft; when the nut member is at the second position, the rotatable basket can be fastened to the drive shaft and the bolt member can be held in a coaxially connected state.

In a preferable fastening device, the drive shaft has a cutout extending upward in an axial direction thereof to occupy a part of the periphery of its lower end portion, and a cavity for engagement which extends radially inward from the surface of the cutout. The bolt member comprises an upright portion projecting upright in the radial direction from part of the periphery of its upper end, and an engaging projection projecting radially from the upright portion. The upright portion and the projection of the bolt member are engaged with the cutout and the cavity of the drive shaft toward the radial direction, whereby the bolt member can be connected to the lower end portion of the drive shaft in axial alignment and the nut member can be screwed on the bolt member. The nut member, when screwed in this manner, can be selectively positioned either at the first position In which the upright portion and the projection are exposed to the outside, or at the second position in which the upright portion and the projection are housed inside of the nut member so as to fasten the rotatable basket.

BEST MODE FOR CARRYING OUT THE INVENTION

Figure 1:
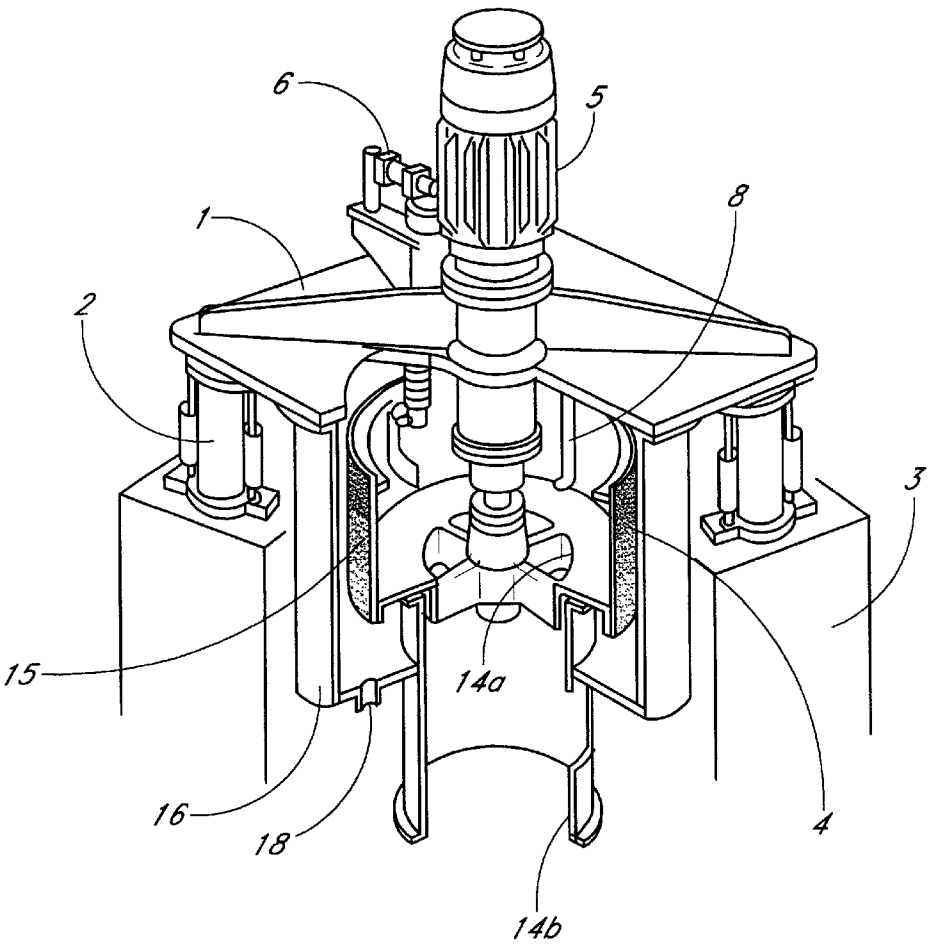
FIG. 1 is a partially sectional perspective view which schematically shows the entire structure of the centrifugal separator of the present invention.
Figure 2:
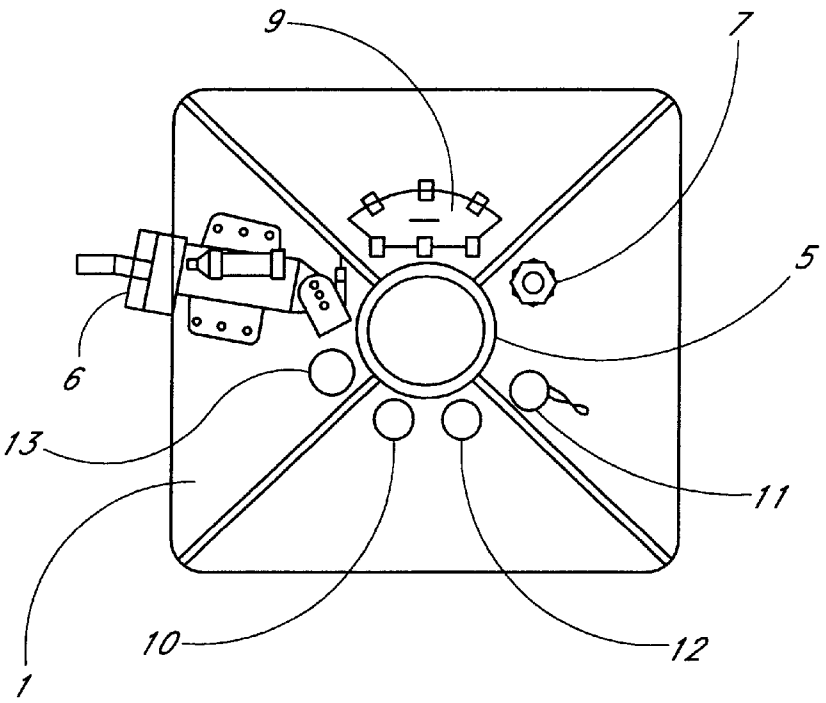
FIG. 2 is a plan view of the centrifugal separator of the present invention shown in FIG. 1.

The present invention in hereinafter illustrated with an exemplary embodiment with reference to attached drawings. FIG. 1 is a partially sectional perspective view which schematically shows the whole of the centrifugal separator of the present invention. A top lid 1 is mounted on a stand 3 via a plurality of supporting legs 2, for example, four supporting legs positioned at intervals of 900. The top lid 1 is equipped with a rotatable basket 4 and a drive unit 5 therefor, a cake scraping device 6, a slurry feeding port 7 (see FIG. 2), a slurry feeding pipe 8, an inside inspection hole 9, an observation window 10, a liquid level detecting device 11, an illumination window 12, an air exit 13 and other auxiliary devices. The rotatable basket 4 comprises a first cake outlet 14*a* at its bottom. As the drive unit 5 are applicable an electric motor, an oil-hydraulic motor, etc. Supporting leg mounting portions of the top lid 1 are reinforced by ribs.

Figure 3:
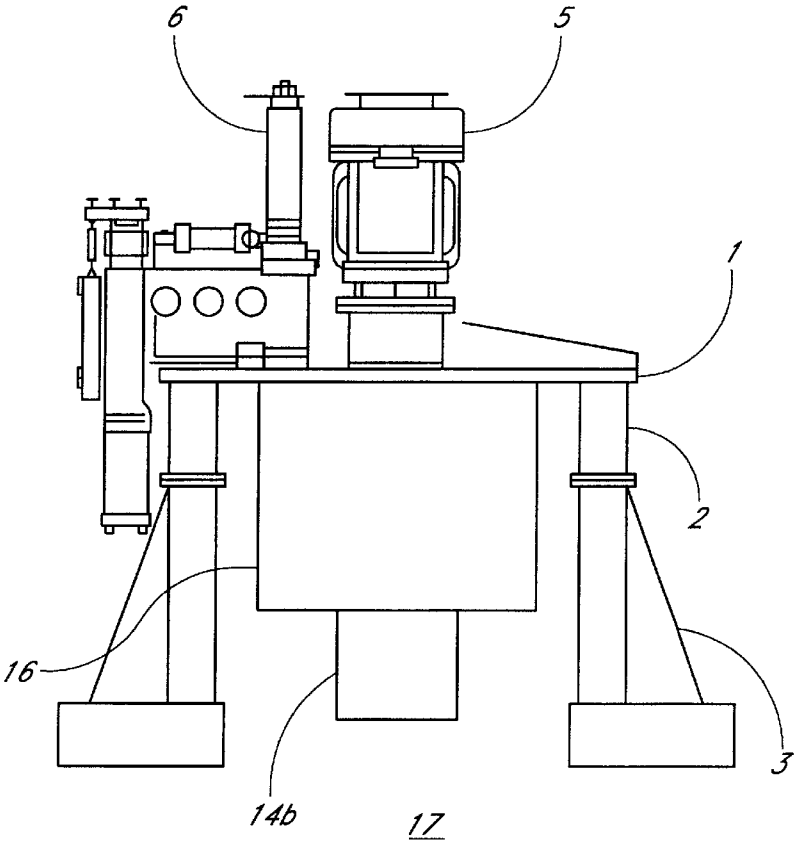
FIG. 3 is a side view of the centrifugal separator.

An outer case 16 is disposed to surround the rotatable basket 4 with a space 15 therearound. The outer case 16 comprises a liquid outlet 18 near outer the periphery of its bottom, and a second cake outlet 14*b* connected to the first cake outlet 14*a* at the center of its bottom independently of the rotation of the first cake outlet 14*a*. The second cake outlet 14*b* projects upward from the bottom of the outer case 16 so as to prevent separated liquids and the like from flowing into the second cake outlet 14*b*. Beneath the cake outlets 14*a* and 14*b* is provided a work space 17 (see FIG. 3), through which a cake receiving container (not shown) can travel on a conveyer or the like from outside.

The materials of the portions which contact directly with processed substances, i.e., the top lid 1, the rotatable basket 4 and the inner surface of the outer case 16, are suitably selected from various stainless steels, hastelloy, polytetrafluoroethylene-coated material and like corrosion-resistant materials.

The rotatable basket 4 serves to centrifugally separate a slurry fed from the slurry feeding port 7 through the slurry feeding pipe 8. Solid component in the slurry are layered to form a cake on the inner wall of the rotatable basket 4. The cake is scraped of f by the cake scraping device 6, discharged downward by its own weight through the cake outlets 14*a* and 14*b* and collected, for example, in the cake receiving container (not shown) placed beneath the cake outlets 14*a* and 14*b*. Liquid component passing through the rotatable basket 4 flows along the inner surface of the outer case 16 and discharged from the liquid outlet 18 at the bottom of the outer case 16, where it is collected as separated liquids.

The above-mentioned structure does not substantially differ from that of the cake bottom discharge type centrifugal separators which have been conventionally used.

The centrifugal separator of the present invention having the above structure is characterized in that the top lid 1 is fixedly mounted on the stand 3 via the supporting legs 2, and that the outer case 16 is detachably attached to the lower side of the top lid 1. Means for attaching the outer case 16 to the top lid 1 are not limited as long as the outer case and the top lid are detachably connected, e.g., attaching with bolts and nuts.

Figure 4A:
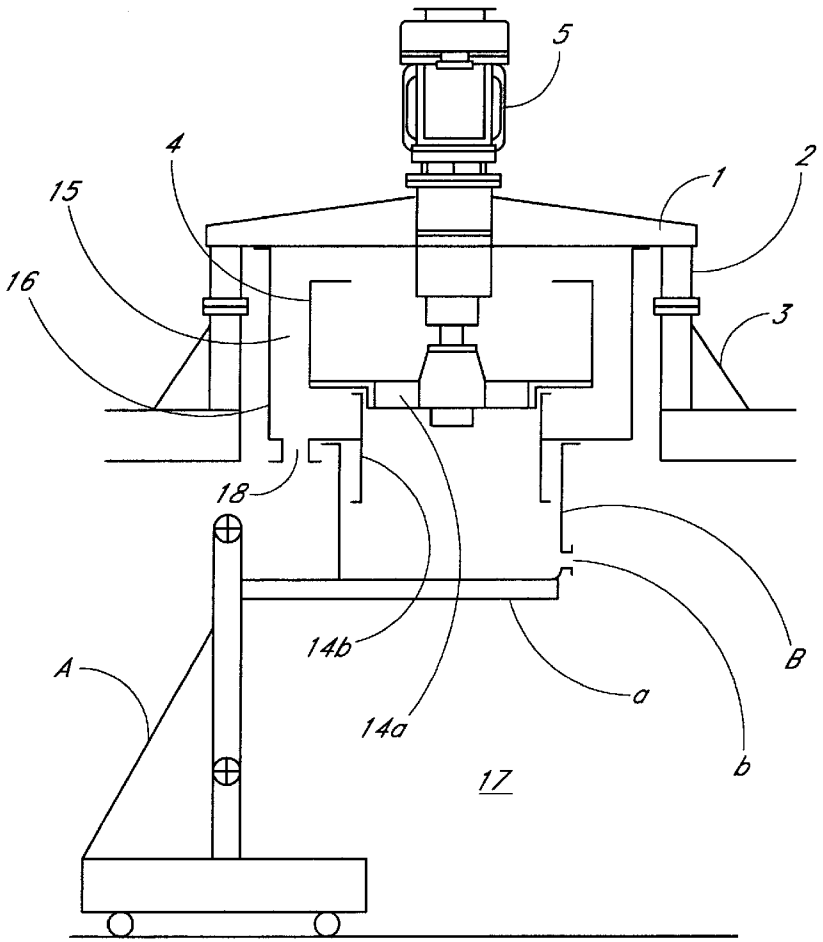
FIGS. 4(*a*)–(*c*) are schematic illustrations which show the arrangements of the centrifugal separator of the present invention during the cleaning process in order.
Figure 4B:
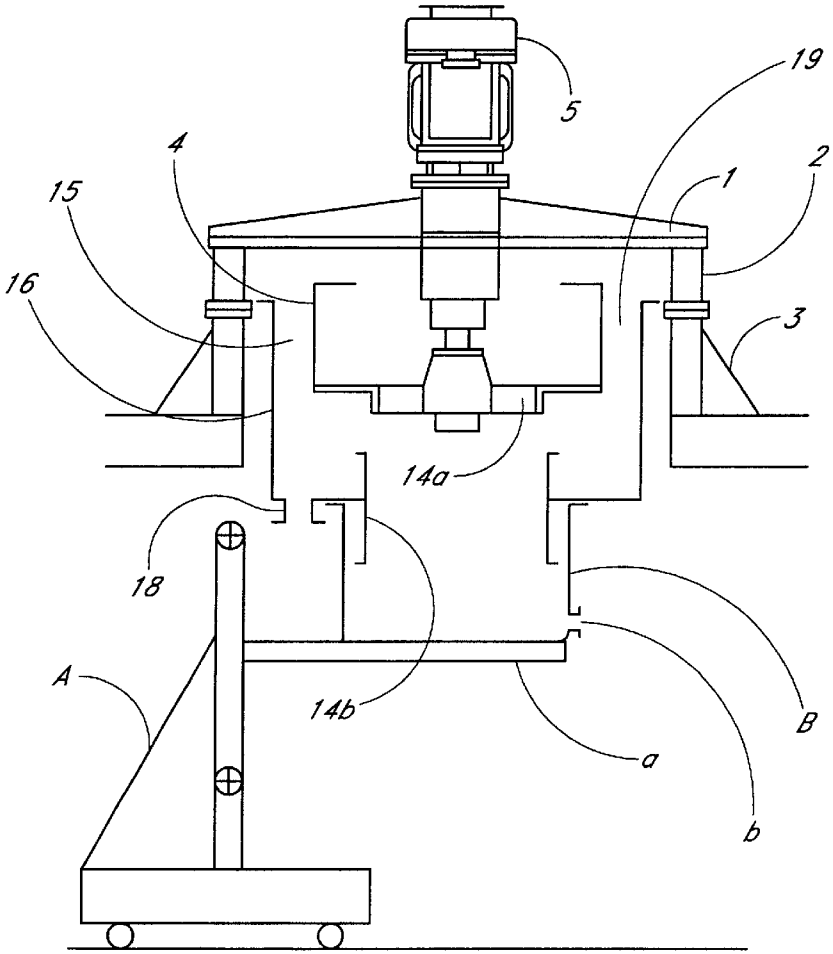
Figure 4C:
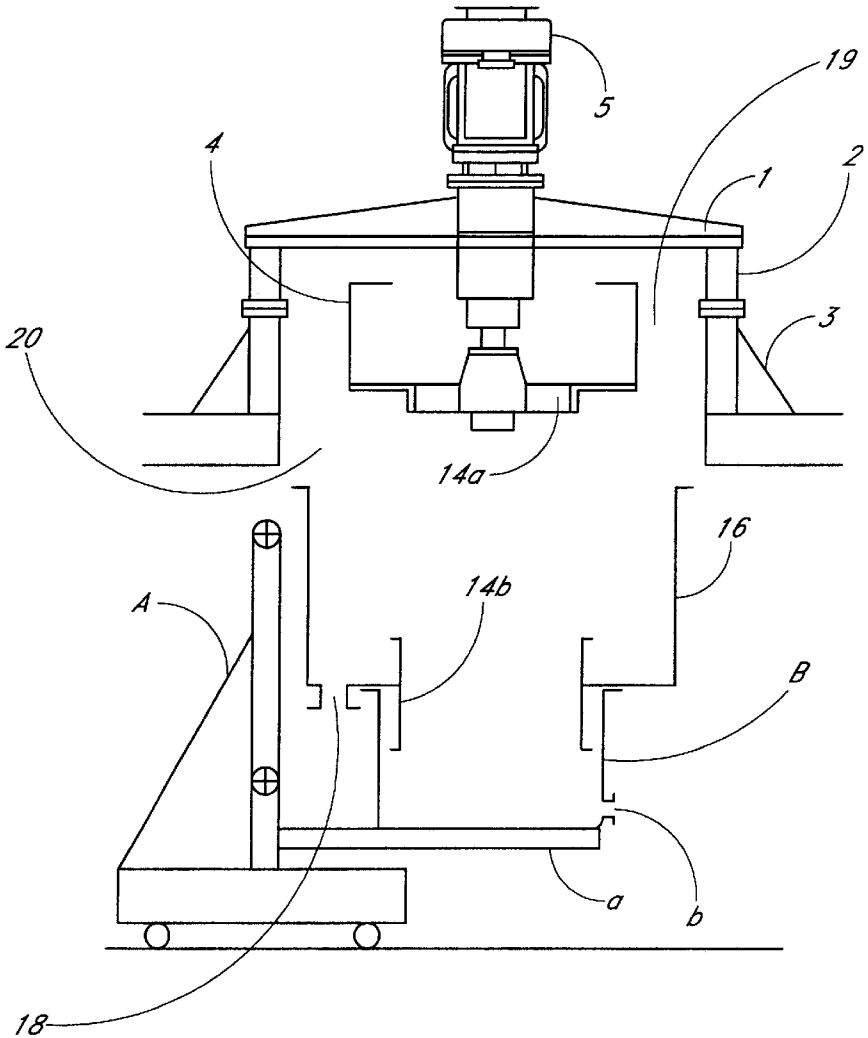

FIGS. 4(*a*), (*b*) and (*c*) show the step-by-step outline of the cleaning operation of the centrifugal separator of the present invention. As shown in FIG. 4(*a*), before starting the cleaning operation, a receiving container B placed on an elevating shelf a of an elevator A is moved to the space 17 under the outer case 16 until the receiving container B is approximately underneath the cake outlet 14*b* of the outer case 16. Then, the elevating shelf a is elevated so that the upper end of the receiving container B contacts the bottom surface of the outer case 16. In this situation, when the outer case 16 is detached from the top lid 1, the overall weight of the outer case 16 is supported by the elevating shelf a via the receiving container B. When the elevating shelf a is lowered from the position shown in FIG. 4(*a*), a first vertical gap 19 is formed between the upper end of the outer case 16 and bottom surface of the top lid 1 as shown in FIG. 4(*b*). The vertical gap 19 expands as the elevating shelf a descends.

As shown in FIG. 4(*b*), the elevating shelf a stops temporarily to conduct a first cleaning, for example, when the upper end of the outer case 16 reaches the hight of the top portion of the rotatable basket 4. During this first cleaning, the rotatable basket 4 is surrounded by the outer case 16. Thus, a cleaning liquid can be sprayed onto the inner and outer surface of the rotatable basket 4 toward the inside from the side, e.g., through the first vertical gap 19, using a cleaning hose and the like, without spilling out the cleaning liquid. It is particularly advantageous for cleaning the inner and outer surface of the rotatable basket 4 with a great amount of residues.

In the first cleaning, a part of the cleaning liquid flows from the rotatable basket 4 into the receiving container B through the cake outlets 14*a* and 14*b*. The cleaning liquid is then discharged from the cleaning liquid outlet b at the bottom of the receiving container B to be collected. The remaining part of the cleaning liquid flows into the outer case 16 and is discharged and recovered from the liquid outlet 18 at the bottom of the case 16 to be collected. Therefore, the first cleaning can be carried out without contaminating the surroundings of the apparatus by the cleaning liquid.

After the completion of the first cleaning, the elevating shelf a is lowered, for example, to the lowest position as shown in FIG. 4(*c*). This allows the first vertical gap 19 to have its largest size and the rotatable basket 4 to be completely exposed to the outside. Therefore, the entire basket can be subjected to a second cleaning while visually checking the cleaning condition of the inside and outside of the basket. In addition, a second vertical gap 20 is formed between the upper end of the outer case 16 and the lower end of the rotatable basket 4. Thus, it is also possible to easily carry out the second cleaning of the outer case 16 entirely while visually checking inside the case through the second vertical gap 20, During the second cleaning, the cleaning liquid used for cleaning the rotatable basket 4 flows into the outer case 16 whose opening portion is disposed thereunder. A part of the cleaning liquid is discharged from the liquid outlet 18 to be collected, and remaining part of the cleaning liquid flows out through the cake outlets 14*a* and 14*b* into the cleaning liquid receiving container B and is discharged and from the cleaning liquid outlet b at its bottom to be collected. Thus, the second cleaning can be conducted visually observing the entire portions to be cleaned without causing contamination of the surroundings by the cleaning liquid.

By the above first and second cleanings, the rotatable basket 4 and the outer case 16 can be washed thoroughly and cleanly.

After finishing the cleaning operations, the arrangement of FIG. 4(*c*) is rearranged to that of FIG. 4(*a*) by lifting the elevating shelf a. Subsequently, the outer case 16 is securely attached to the bottom surface of the top lid 1 using bolts, nuts and the like, to prepare for the next separation of slurry into solids and liquids.

This rearrangement operation requires simply lifting up the outer case 16, and does not need any process for resetting peripheral equipments. Hence, it can be carried out quickly and unfailingly.

As aforementioned, the present invention can provide a cake bottom discharge type centrifugal separator which is excellent in operability, cleanability, visual observability and antipollution property.

In the present invention, the cleanability can be even more increased by detaching the rotatable basket 4 from the drive shaft 5*a* of the drive unit 5 in the arrangement of FIG. 4(*c*) to clean the rotatable basket 4 in a detached state.

The rotatable basket 4 is usually fixed to the drive shaft 5*a* by fastening a nut screwed onto a threaded portion of the lower drive shaft 5*a*. The rotatable basket 4 can be downwardly drawn out from the drive shaft 5*a* by removing the nut therefrom. When the rotatable basket 4 is fixed on the drive shaft 5*a*, the nut have to be screwed onto the threaded portion, which operation is usually carried out overhead and thus accompanies difficulty. Screwing operation is very troublesome especially in large centrifuge separators because they use a large, heavy nut. Further, repeated fastening and releasing of the nut gradually damage the threads, necessitating replacement eventually. In the drive shaft having an integral threaded portion, the entire shaft has to be replaced with a new one. Such operation is not only troublesome, but also very costly especially when the drive shaft to be replaced is made of anticorrosion materials such as hastelloy or the like.

Figure 5:
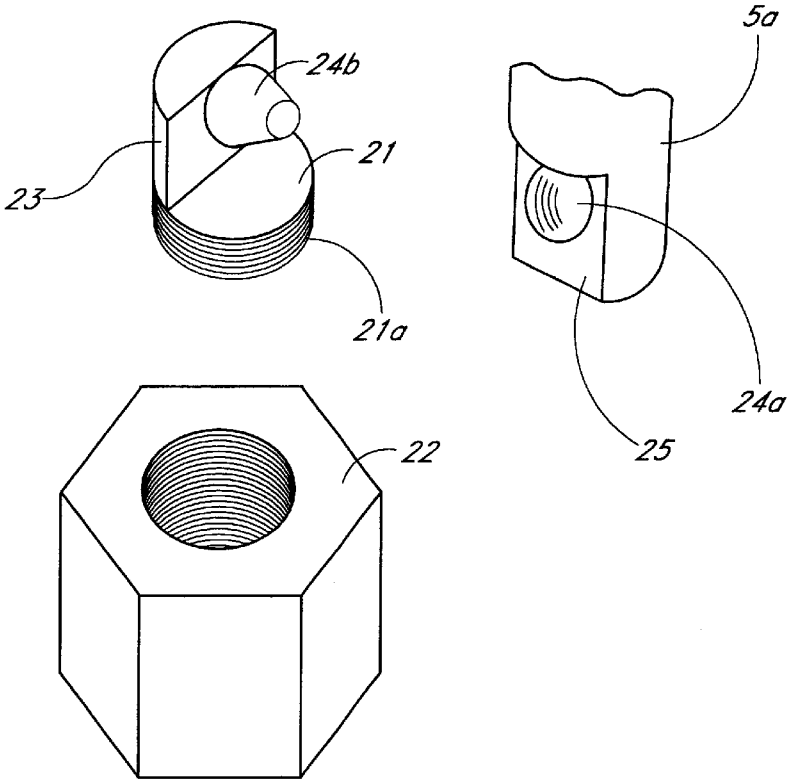
FIG. 5 is an exploded perspective view of the fastening device applied to the lower end portion of the drive shaft of the rotatable basket.
Figure 6:
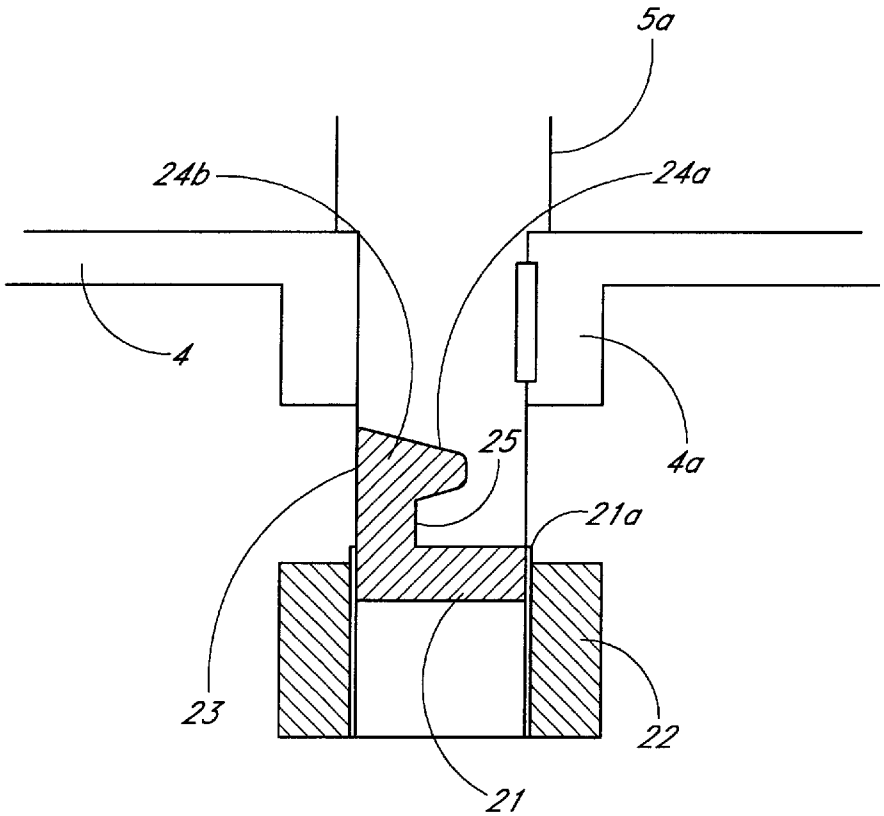
FIG. 6 is a partially sectional vertical view which shows the arrangement of the fastening device mounted at the lower end portion of the drive shaft before fastening.
Figure 7:
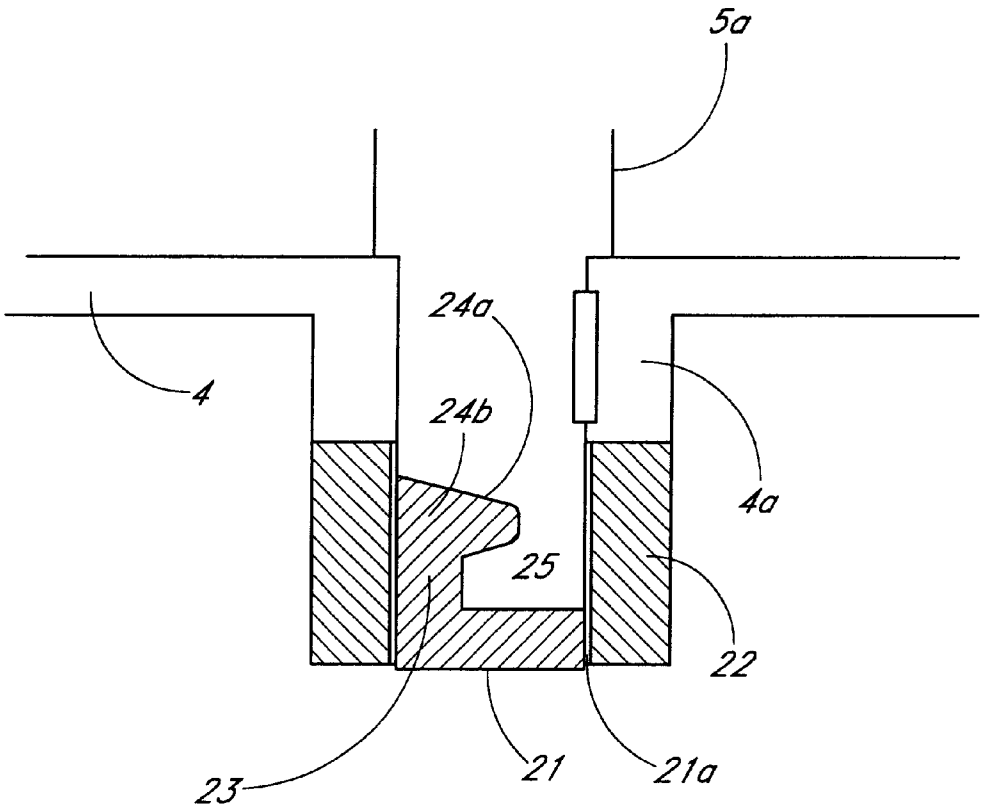
FIG. 7 is a partially sectional vertical view which shows the arrangement of the fastening device after fastening.

FIGS. 5 to 7 show an example of the fastening device for the rotatable basket 4 which can overcome the above problems. FIG. 5 shows the disassembled fastening device which comprises a bolt member 21 and a nut member 22 which engages the threaded portion 21*a* of the bolt member 21. The threads of the members 21 and 22 are formed in such directions that the screws are tightened as the drive shaft 5*a* rotates in order to avoid loosing.

The bolt member 21 has approximately the same diameter as the drive shaft 5*a* and is equipped with an upright portion 23 extending upward, for example, at an angle ranging from 60 to 90°, to occupy a part of the periphery of the upper portion which has, for example, a circular arc shape in plan view. The bolt member 21 also has a projection 24*b* for engagement projecting radially from the upright portion 23. The lower end of the drive shaft 5*a* is formed with a cutout 25 occupying a part of the periphery thereof and a cavity 24*a* for engagement extending radially inward from the surface of the cutout 25. By engaging the upright portion 23 and the projection 24*b* of the bolt member 21 with the cutout 25 and the cavity 24 toward the radial direction, the bolt member 21 can be connected in axial alignment with the lower end portion of the drive shaft 5*a*. By disengaging the upright portion 23 and the projection 24*b*, the bolt member 21 can be detached from the drive shaft 5*a* connected coaxially thereto toward the radial direction. The advantageous shapes of the cavity 24*a* and projection 24*b* for engagement are, for example, those which reduce the diameter gradually toward inside and outside respectively, such as cones, hemisphere and other shapes.

The length of the nut member 22 in the axial direction is approximately the same as the overall length of the bolt member 21 including the upright portion 23. Threads are formed on the allover inner surface of the nut 22.

In order that the bolt member 21 is connected to and aligned with the drive shaft 5*a*, the nut member 22 is partly screwed onto the threaded portion 21*a* of the bolt member 21 as shown in FIG. 6. In this screwed state, the upper end of the nut member 22 maintains the first position which is lower than the projection 24*b* so that it does not interfere with the engagement operation of the engaging cavity 24*a* and projection 24*b* toward the radial direction.

When the nut member 22 is at the first position, the bolt member 21 is connected in axial alignment to the drive shaft 5*a* by the engagement operation of the cavity 24*a* and projection 24*b* toward the radial direction.

Connected in this manner, the nut member 22 is fastened so that the rotatable basket 4 is fixed to the drive shaft 5*a*. As shown in FIG. 7, in this fastened state, the upper end of the nut member 22 is forced on the lower end of a boss portion 4*a* of the rotatable basket 4 and maintains the second position which is higher than the engaging projection 24*b*. Thus, the engaging cavity 24*a* and the projection 24*b* are placed inside the nut member 22 and held as engaged. Accordingly, after the nut member 22 is fastened, the bolt member 21 is securely connected and fixed to the drive shaft 5*a* in axial alignment therewith, and remains connected and fixed state stably and reliably.

When employing the fastening device of the above-mentioned structures attachment operation of the rotatable basket 4 can be quickly and unfailingly carried out without the troublesome overhead screwing operation since the bolt member and nut member can be preliminarily screwed together on the ground.

Moreover, when the threaded portion is damaged, only the bolt member 21 or nut member 22 needs to be replaced with new one because the bolt member 21 is separate from the drive shaft 5*a*. Therefore, it is very economical that there is no need to replace the drive shaft.

What is claimed is:

1. A centrifugal separator comprising a top lid, a rotatable basket, a drive unit for the rotatable basket and an outer case, the rotatable basket and the drive unit being mounted on the top lid, the rotatable basket and the outer case having a cake outlet at the bottoms thereof, wherein the top lid is fixedly mounted on a stand via supporting legs, the outer case being supported by and attached to the top lid, the outer case being detachable from the top lid for cleaning and movable downward when detached, whereby the rotatable basket can be exposed to the outside.

2. The centrifugal separator according to claim 1, wherein the outer case detached from the top lid can be moved vertically beneath the rotatable basket by using an elevator.

3. The centrifugal separator according to claim 1 or 2, wherein a cleaning liquid receiving container can be placed below the bottom of the outer case detached from the top lid in a manner of surrounding the periphery of the cake outlet, the receiving container having a cleaning liquid outlet at a lower portion thereof.

4. The centrifugal separator according to claim 1, wherein the rotatable basket is removably attached to its drive shaft, the drive shaft is equipped with a fastening device for fastening the rotatable basket to the drive shaft at the lower end portion of the drive shaft, the fastening device comprising a bolt member which can be connected to and axially aligned with the lower end portion of the drive shaft by placing from the radial direction of the lower end portion thereof, and a nut member screwed onto the bolt member, the nut member being screwed selectively either at a first position, a lower part of the bolt member, or at a second position, an upper part of the bolt member, the first position allowing placement of the bolt member to the drive shaft from the radial direction to make the axial alignment of them, the second position allowing fastening of the rotatable basket to the drive shaft and connection of the bolt member to the drive shaft with the axial alignment.

5. The centrifugal separator according to claim 4, wherein the drive shaft comprises a cutout extending upward from the lower end in the axial direction thereof to occupy a part of the periphery of its lower end portion and a cavity for engagement extending radially inward from the surface of the cutout, the bolt member comprising an upright portion projecting upward and in the axial direction to occupy a part of the circumference of its upper end and a protrusion for engagement projecting radially from the upright portion, the bolt member being connectable in axial alignment with the lower end portion of the drive shaft by engaging the upright portion and the projection of the bolt member with the cutout and the cavity of the drive shaft toward the radial direction, the nut member being screwed onto the bolt member, the nut member, in this screwed state, being positioned selectively either at the first position which allows the upright portion and the projection to be exposed to the outside or the second position which allows the rotatable basket to be fastened with the upright portion and the projection housed inside of the nut member.

* * * * *